US006487830B2

(12) United States Patent
Robertson

(10) Patent No.: US 6,487,830 B2
(45) Date of Patent: Dec. 3, 2002

(54) REFLECTIVE BALLASTED ROOFING SYSTEM AND METHOD

(75) Inventor: Ross H. Robertson, Cicero, IN (US)

(73) Assignee: BFS Diversified Products, LLC, Carmel, IN (US)

( * ) Notice: Subject to any disclaimer, the term of this patent is extended or adjusted under 35 U.S.C. 154(b) by 0 days.

(21) Appl. No.: 09/768,886

(22) Filed: Jan. 24, 2001

(65) Prior Publication Data

US 2002/0095907 A1 Jul. 25, 2002

(51) Int. Cl.[7] ..... E04B 1/00

(52) U.S. Cl. ..... 52/745.06; 52/408; 52/515; 52/741.3; 52/746.11

(58) Field of Search ..... 52/745.06, 746.1, 52/746.11, 741.3, 408, 515, 516

(56) References Cited

U.S. PATENT DOCUMENTS

| | | | | |
|---|---|---|---|---|
| 2,388,880 | A | * 11/1945 | Stitt | 52/144 X |
| 3,068,956 | A | * 12/1962 | Cooley | 52/144 X |
| 4,279,536 | A | 7/1981 | Jarlan | |
| 4,506,483 | A | 3/1985 | Phalen, Jr. | |
| 4,535,579 | A | 8/1985 | Burgoyne et al. | |
| 4,736,561 | A | * 4/1988 | Lehr et al. | 52/746.11 X |
| 4,899,514 | A | 2/1990 | Brookhart, Jr. | |
| 5,377,468 | A | 1/1995 | Repasky | |
| 5,887,397 | A | 3/1999 | Repasky | |
| 2001/0047628 | A1 | * 12/2001 | Mouton et al. | 52/144 |

OTHER PUBLICATIONS

Tatum, Rita, "Cool Roofs, Hot Topic", May/1999, Building Operating Management, pp. 56–70.*

Sturdevant, Nicole, "Reflective Roofs Return Multiple Dividends", May/2000, Building Operating Management, pp. 105–116.* excerpts from Heat Island Group website EETD.LBL.gov, "Cool Roofs", "Roof Heat Transfer", and "Demonstration of Energy Savings of Cool Roofs", Apr. 27, 2000, 9 pages total.*

US Deparation of Energy, "Working to Cool Urban Heat Islands", Jun. 1996, 3 pages publication.*

Rosenfeld, Arthur, Romm, Akbari, and Lloyd, "Painting the Town White—and Green", originally published in the Feb./Mar. 1997 issue of MIT's Technology Review.*

Gatland, Dr. Lisa M., "Cool Coating Heat Up Savings", originally published in Maintenance Solutions in Jan./1999.* excerpts from Cool Roofing Materials Data Base of the Lawrence Berkley National Laboratory from their website EETD.LBL.gov/CoolRoofs/(including website frame dates of May 10, 1999, Sep. 22, 1999, and Oct. 12, 1999), 12 pages total.*

"SOLEC LO/MIT–I/II Applications: Roof Coating" from the website www.solec.org (including website frame date of Aug. 27, 2001), 4 pages total*

Bretz et al., Practical Issues for Using Solar–Reflective Materials to Mitigate Urban Heat Islands, pp. 95–101, Mar., 1997, Great Britain (Atmospheric Environment, vol. 32, No. 1).

* cited by examiner

*Primary Examiner*—Laura A. Callo
(74) *Attorney, Agent, or Firm*—Meredith Palmer; Andrew B. Morton

(57) ABSTRACT

A method for constructing a ballasted roof system (20) includes the steps of installing a roofing membrane (14) onto a roof structure (12). A ballast (16, 32) is disposed on the roofing membrane, wherein the ballast has applied thereto a reflective paint (21) to improve the solar reflective properties of the ballasted roof system. The improved roofing system has solar reflective properties at least 35%.

8 Claims, 1 Drawing Sheet

REFLECTIVE BALLASTED ROOFING SYSTEM AND METHOD

FIELD OF THE INVENTION

The present invention relates generally to roofing systems. More particularly, it relates to a ballasted roofing system in which ballast material holds in place a roofing membrane. The ballast material has improved reflective properties.

BACKGROUND OF THE INVENTION

Steep sloped roofs are relatively expensive to construct; accordingly, many industrial and office buildings employ low sloped roofs. Low sloped roofs often are covered with polymeric membranes to protect the underlying building from the elements. Care must be taken to maintain the integrity of the membrane to prevent the development of gaps or openings.

Often, ballast material is applied over a roofing membrane to keep it from uplifting in wind and to maintain the integrity of seams formed when two or more adjacent membrane sheets abut one another. Also, ballast material can protect the membrane from UV light degradation, which can compromise the physical integrity of the membrane. The ballast also serves to project the membrane from damage such as hail, wind-blown debris, and fire.

At least about 280,000,000 $m^2$ of ballasted roof systems presently are in place in the United States, and another 25,000,000 $m^2$ of such systems are installed annually.

Obviously, building owners desire to reduce the costs necessary to cool their buildings, particularly in warmer areas with a great deal of sun exposure. Additionally, existing roof surfaces are believed to contribute to the "heat island" effect observed in urban areas.

Many ballasted roof systems utilize standard ballast rock, which reflects 12–20% of solar spectrum energy. Ballast rock preferably is sized to ASTM Standard No. 4 and uniformly distributed over a membrane in an amount of about 5 $kg/m^2$. However, naturally reflective rock is practical only when available locally. Transportation costs significantly increase when the rock is quarried far from the site of the roof.

Somewhat higher reflectance can be obtained by using a natural quartzite rock. However, such quartzite does not resist mildew and, over time, catches dirt, both of which reduce its reflectance properties.

Natural color paver blocks also can be used in ballast roofing systems. These can increase the solar reflectivity up to about 34% of solar spectrum energy.

With known ballasted roof systems, solar reflectance is relatively small and heat generation by the roofing system, and thus heat absorption by the underlying building, is unacceptably high. This results in significant cooling costs for such buildings.

A solar-reflective ballasted roof system that improves the solar reflectance of the roof and significantly reduces the amount of heat transferred to the underlying building structure remains an unmet need in the art.

SUMMARY OF THE INVENTION

Briefly, the present invention provides a method for constructing a ballasted roof system that includes a roof structure covered by a roofing membrane with ballast disposed thereon. Reflective paint is applied to the ballast to improve the solar reflective properties of the roof system. The ballast material can take the form of, for example, paver blocks and/or smooth, water-worn gravel.

In a roof system of the type just described, the ballast material can have a solar spectrum reflectance of at least 35%, and preferably at least about 50%. Reflectance, as used herein, is the fraction of solar spectrum (radiation originating from the sun including ultraviolet, visible, and near-infrared radiation) that is reflected by a surface expressed as a percent or within the range of 0.00 to 1.00. By utilizing a reflective paint on the ballast material, the roof system generates less heat to be absorbed by the ballast material and the underlying building, thus reducing cooling costs. Since less heat is absorbed by the ballast material (roof surface), then the present invention contributes to a city's reduction of the heat island effect.

Paint can be applied in a single step by, e.g., dip coating. However, prior to applying the reflective paint to the ballast material, the latter preferably is weatherized so that its receptivity to the paint is increased. Thereafter, paint can be applied in a single spraying or, preferably, in at least two separate sprayings. A first coat can be applied in one direction, and second coat can be applied in a substantially opposite (~180°) or a substantially orthogonal (~90°) direction. An advantage of such a dual coating to already-in-place ballast is that the applied paint adheres to the ballast, but separate pieces of the ballast material do not adhere to one another nor to the roofing membrane.

The present invention provides an economical method for applying a reflective surface which advantageously does not significantly increase the cost or time involved in installing a ballasted roofing system. Nevertheless, substantial cost savings to the building owner (through lower energy usage involved in cooling the building) can be realized.

The following definitions apply hereinthroughout unless a contrary intention is expressly indicated:

BRIEF DESCRIPTION OF THE DRAWINGS

For a more complete understanding of the invention, reference can be made to the following detailed description and accompanying drawings.

DETAILED DESCRIPTION OF ILLUSTRATIVE EMBODIMENTS

Figure 1:
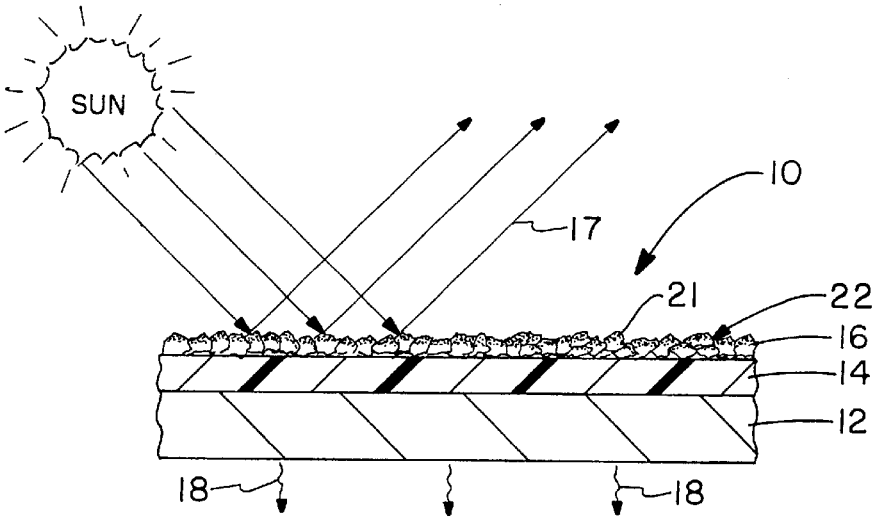
FIG. 1 is a schematic cross-sectional illustration of a reflective ballasted roof system employing ballast rock.
Figure 2:
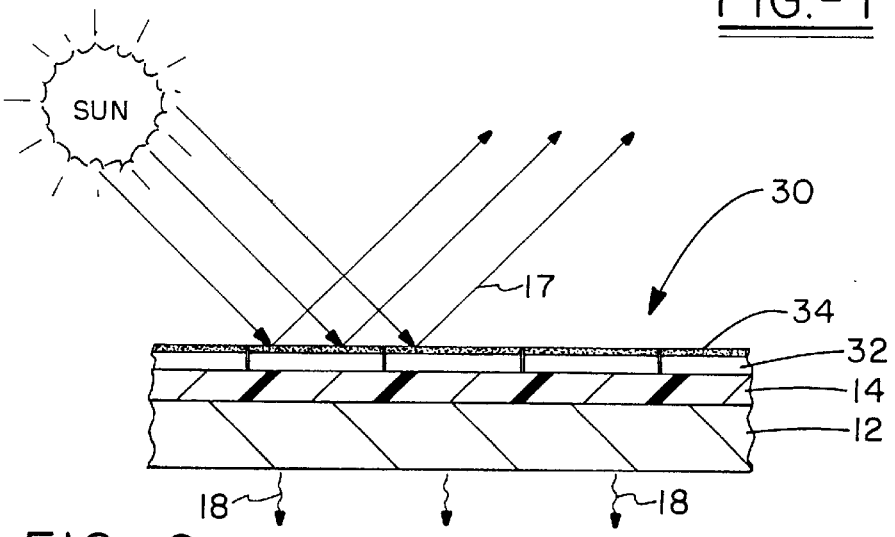
FIG. 2 is a schematic cross-sectional illustration of a reflective ballasted roof system employing paver blocks.
Figure 3:
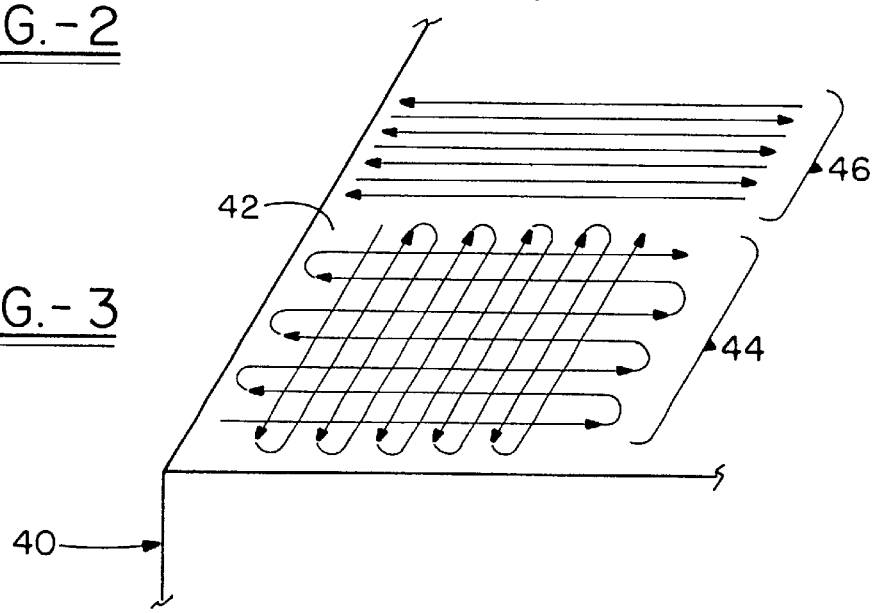
FIG. 3 is a perspective view of a building structure showing different methods of applying reflective paint to a ballasted roof system.

Referring now to FIGS. 1–3, a solar-reflective ballasted roof system is designated generally by the numeral 10. The system 10 includes a roof structure 12 which is covered by a membrane 14. The membrane 14 is typically a polymeric material, which may be in the form of sheets seamed to one another, and may include other structural features necessary for attaching the membrane 14 to the roof structure 12. A ballast material, in the form of smooth water-worn gravel 16, is distributed about the single-ply membrane. As shown in FIG. 1, a minimal amount of sunlight 17 is reflected by the roof system 10. Of course, the sunlight which is not reflected is absorbed in the form of heat rays 18. In a preferred embodiment, the roof system 10 is constructed and the surface of the ballast material, either smooth, worn gravel or paver block, is allowed to weather. In other words, the ballast material is exposed to natural wind and/or rainfall to remove residual dirt from the top ballast surfaces. This natural cleaning is the only preparation required before treatment.

Once the ballast material 16 is dry, a high performance paint 21 is applied to the exposed surfaces of the ballast in a manner to be described. Accordingly, the ballast material 16 is transformed into reflective ballast material designated generally by the numeral 22. The paint is specifically designed to be highly solar reflective and to maintain a clean, mildew-resistant, durable, and reflective surface under severe exposed conditions expected on ballasted roof systems. The type of paint selected is compatible with the most commonly quarried rock.

Preferably, paint is applied to the ballast material as an on-site treatment. The reflective paint may be applied to both new and existing systems wherein the paint is specifically designed to improve the solar reflectance of typical ballast surfaces, without otherwise affecting other desirable attributes of the existing roof system. With this treatment, only the ballast surface is visibly changed and its solar reflectance is increased. The paint preferably used is a latex gloss or acrylic paint, such as PC-101 WHITE RB-1, provided by Rohm & Haas. The paint 21 is specifically designed not to stick individual ballast pieces together or to adhere the ballast pieces to the membrane 14. Moreover, application of such a reflective material does not significantly affect the future repair of an existing ballasted roof system.

As represented in FIG. 1, application of a reflective painting significantly increases the magnitude of the reflected sunlight 17, while minimizing the amount of heat 18 created. Testing has shown that individual ballast rock surfaces treated with reflective ballast paint score a solar reflectance of greater than 80%. Moreover, an entire ballast rock surface of a treated ballasted roof system has been shown to score a solar reflectance of about 55% to 60%.

Referring now to FIG. 2, the smooth water-worn gravel may be replaced with paver blocks in an alternative solar-reflective ballasted roof system designated generally by the numeral 30. The system 30 includes paver blocks 32 positioned on the membrane 14 in a manner known in the art. After the paver blocks 32 are in place and weathered for a predetermined period of time, a reflective coating 34 is applied to the top surface of the paver blocks 32 in a manner that will be described. Although the paver blocks are heavier to transport and take longer to assemble, it will be appreciated that their relatively flat surface increases their solar reflectivity. By utilizing the reflective paint 21 upon the paver blocks 32, reflectance of the system can be increased to greater than 80%.

FIG. 3 shows a building structure 40 having a roof 42. A first method of applying reflective paint is designated generally by the numeral 44. In this method, the reflective paint 21 is applied with a standard commercial airless paint sprayer. The paint is a water-based product and, as such, the air and surface temperatures must be above about 4° C. during and just after application. The method 44 shows that the paint is applied in a first direction in a predetermined area. A second application of paint is then made, after the first application has dried, in a direction substantially 90° or orthogonal to the first direction. This double coating provides more than adequate coverage while efficiently using a minimum quantity of paint. In this back-and-forth motion, there is an approximate 30% overlap between passes. Moreover, it has been found that the spray is most concentrated in the middle 60%±of the fan pattern. As such, the 30% overlap evens out the coat. Spray tip wear is an important factor in the paint coverage and testing indicates that the tip of the sprayer should be replaced after application of about fifty gallons.

An alternative application method is designated generally by the numeral 46. In this method, paint is applied in a first direction and then after that application has dried, a second coat of paint is applied in a direction substantially 180° or opposite the first direction. Both application methods 44 and 46 improve the reflectance properties of untreated ballast rock material. Testing has shown that the method 46 provides better and more uniform reflectivity than the method 44. It will be appreciated by those skilled in the art that the angle at which the paint is applied is critical to obtain maximum reflectance. The spray angle in the first direction is somewhere between 45° and 90° with respect to the surface in the other direction. In other words, the spray angle is an acute angle in the first direction and an obtuse angle in the second direction. This provides complete coverage of the exposed ballast surface. Although an improvement over unpainted ballast material, the coverage provided by a single application is not as complete or as uniform.

The top surface and a substantial portion of the side surfaces of the rock are covered with the reflective paint using the methods described above. Painting the ballast rocks by one of the aforementioned methods also results in the rocks not adhering to one another or to the membrane. This is advantageous inasmuch as the rocks may be moved at a later time so that repairs may be made to the membrane when needed. This method also allows for installers of the system to inspect the roofing system to determine whether unauthorized activity on the roofing membrane, which may void the warranty, has occurred. In other words, if an individual walks across the membrane without benefit of walkway pads, then the overturned rocks will show surfaces which were not painted with the reflective material. Accordingly, evidence of excessive turnover not attributable to weatherrelated events, can allow the installer to inspect the roofing system for improper use.

Although a preferred embodiment contemplates applying paint after the ballast materials are installed on the roofing membrane, the ballast material may be painted at an off-site location. Unfortunately, this would cover all of the rock material and provide for excessive weight in transportation costs. Moreover, since only a portion of the rocks are exposed to the sun, a significant portion of the applied paint would not be effective as a reflectant. Additionally, the applied paint may chip during transit.

The present invention is advantageous for several reasons. The primary advantage is that the reflective properties of the roofing system are significantly improved. As evidenced by testing of the aforementioned systems, the reflective properties can be anywhere from 35%, preferably to greater than 80%, which is a significant improvement over the prior art. Use of the present invention may be employed in new or previously constructed roofing systems. The cost of such a system is significantly outweighed by the improved energy utilization and the significantly reduced thermal pollution in urban areas.

In order to demonstrate the practice of the present invention, the following examples have been prepared and tested. The examples should not, however, be viewed as limiting the scope of the invention. The claims will serve to define the invention.

Various modifications and alterations that do not depart from the scope and spirit of this invention will become apparent to those skilled in the art. This invention is not to be duly limited to the illustrative embodiments set forth herein.

What is claimed is:

1. A method for constructing a ballasted roof system comprising:

covering a roof structure with a polymeric roofing membrane and subsequently a ballast material;

applying to said ballast material a reflective paint to improve the solar reflective properties of the ballasted roof system, wherein said ballast material is a layer of ballast rock distributed about the roofing membrane; and wherein said step of applying comprises the steps of:

first applying a coat of said reflective paint in a first direction; and next applying a second coat of said reflective paint in a second direction substantially opposite said first direction.

2. The method according to claim 1, wherein during said applying step said reflective paint adheres to said ballast rock, but not to the membrane and in such a way that said ballast rocks do not adhere to one another.

3. The method according to claim 2, wherein said applying steps include the step of angularly applying said reflective paint at an angle somewhere between 45° and 90° with respect to the surface in the other direction, so that the spray angle is an acute angle in the first direction and an obtuse angle in the second direction.

4. A method for constructing a ballasted roof system comprising:

covering a roof structure with a polymeric roofing membrane and subsequently with a ballast material disposed thereon;

applying to said ballast material a reflective paint to improve the solar reflective properties of the ballasted roof system, wherein said ballast material is a layer of ballast rock distributed about the roofing membrane; and wherein said step of applying comprises the steps of:

first applying a coat of said reflective paint in a first direction; and next applying a second coat of said reflective paint in a second direction substantially orthogonal to said first direction.

5. The method according to claim 4, wherein during said applying step said reflective paint adheres to said ballast rock, but not to the membrane and in such a way that said ballast rocks do not adhere to one another.

6. The method according to claim 5, wherein said applying steps include the step of angularly applying said reflective paint at an angle somewhere between 45° and 90° with respect to the surface in the other direction, so that the spray angle is an acute angle in the first direction and an obtuse angle in the second direction.

7. A method for constructing a ballasted roof system comprising:

covering a roof structure with a polymeric roofing membrane and subsequently with a ballast material;

applying to said ballast material a reflective paint to improve the solar reflective properties of the ballasted roof system;

wherein said ballast material are paver blocks distributed about the roofing membrane; and wherein said step of applying comprises the steps of:

first applying a coat of said reflective paint in a first direction; and next applying a second coat of said reflective paint in a second direction substantially orthogonal to said first direction.

8. The method according to claim 7, wherein said applying steps include the step of angularly applying said reflective paint at an angle somewhere between 45° and 90° with respect to the surface in the other direction, so that the spray angle is an acute angle in the first direction and an obtuse angle in the second direction.

* * * * *